United States Patent [19]

Jesty et al.

[11] 4,030,407

[45] June 21, 1977

[54] BINDING APPARATUS

[75] Inventors: Thomas William Jesty, Dorchester; John Anderson, East Molesey, both of England

[73] Assignee: T.W. Jesty & Partners, Dorchester, England

[22] Filed: Sept. 18, 1975

[21] Appl. No.: 614,438

[30] Foreign Application Priority Data

Sept. 20, 1974 United Kingdom ..... 41108/74

[52] U.S. Cl. ..... 100/4; 53/198 A; 100/7; 100/17; 140/93 A

[51] Int. Cl.[2] ..... B65B 13/28

[58] Field of Search ..... 100/4, 7, 17, 31, 11; 53/198 A; 140/93 A

[56] References Cited

UNITED STATES PATENTS

| | | | |
|---|---|---|---|
| 2,354,410 | 7/1944 | Suelflow | 100/17 |
| 3,068,780 | 12/1962 | Gates et al. | 100/4 |
| 3,141,277 | 7/1964 | Johnston | 53/198 A |
| 3,389,039 | 6/1968 | Steckler | 100/17 X |
| 3,825,039 | 7/1974 | Crabb | 140/93 A |

FOREIGN PATENTS OR APPLICATIONS

| | | | |
|---|---|---|---|
| 1,568,980 | 4/1969 | France | 100/17 |

*Primary Examiner*—Billy J. Wilhite
*Attorney, Agent, or Firm*—Christensen, O'Connor, Garrison & Havelka

[57] ABSTRACT

Pneumatic apparatus for drawing binding strip from a stock roll, winding a length of the strip around a bunch of water cress, severing that length from the strip stock and twisting the ends of the length of strip together to form a tie around the bunch. The apparatus includes a two-armed lever. One of the arms is arcuate and has a profiled end which is adapted to engage the leading end of the length of strip and, as the lever is swung about its fulcrum, to push that leading end around the bunch into a bight in the periphery of an apertured disc. The trailing end of the length of strip is located within the aperture of the disc so that it is held from following the leading end. The disc is rotated to twist the two ends together and the lever is then swung back so that the other arm ejects the bound bunch from the apparatus.

25 Claims, 9 Drawing Figures

BINDING APPARATUS

This invention relates to apparatus for forming a loop of strip material around matter to be tied so that the ends of a length of strip material so looped can be twisted together to complete a tie which retains the encircled matter therein.

The object of this invention is to provide apparatus of the kind referred to above which can be used to loop an elongate tie around a bunch of elongate articles, especially vegetable matter such as water cress or flowers.

A known form of strip material for looping around matter to be tied and tying by twisting the ends of a length thereof so looped comprises wire reinforced paper or plastics tape. The reinforcing wire is embedded in the tape and extends along the longitudinal centre line thereof. Such tape can be obtained as continuous tape wound onto a suitable spool or reel and from which lengths can be cut to suit requirements. Alternatively the tape can be obtained as pre-cut strips which are a few inches in length.

Apparatus exists for tying the necks of paper or plastic bags automatically with ties which comprise lengths of such wire reinforced tape, each tie being wrapped around the neck of the bag to be tied and having its ends twisted together. When such apparatus is operated to tie the neck of a bag, the neck of the bag is positioned within a cylindrical enclosure, strip material is drawn from a stock thereof, which comprises a continuous length thereof, and is fed longitudinally into the cylindrical enclosure between the neck of the bag and the inner cylindrical wall of the enclosure so that the leading end of the strip first engages the inner cylindrical wall of the enclosure and then is guided around the neck of the bag by engagement with that cylindrical wall. Once the leading portion of the strip material has been looped around the neck of the bag, it is cut from the stock of strip material and the ends of the cut length are twisted together to complete the tie.

The length of strip material required to form such a tie around the neck of a paper or plastics bag is of the order of two or three inches. Approximately seven or eight inches of such strip material are required for tying a bunch of water cress and we have found that the control of such a length of strip material is inadequate if a cylindrical surface which surrounds the bunch of water cress is relied upon to guide the leading end of the strip around the water cress. For this reason we have found that the kind of apparatus that is in current use for tying the necks of paper or plastics bags automatically is unsuitable for tying bundles of water cress automatically.

According to this invention there is provided apparatus for forming a loop of strip material around a bunch of elongate articles which is to be tied so that the ends of a length of strip material so looped can be twisted together to complete a tie around the bunch, the apparatus comprising means for locating a length of strip material adjacent a station at which a bunch of elongate articles to be tied is positioned during use of the apparatus, the strip material locating means being adapted to locate such a length of strip material so that it extends laterally with respect to a bunch of elongate articles positioned at said station, movable means movable along an orbital path around said station and adapted to engage one end of a length of strip material located adjacent said station by said strip material locating means so as to move that end around a perimeter of said station, and restraining means which coact with the other end of the length of strip material and restrain that other end from following said one end as said one end is moved around the station by the movable means so that the length of strip material is looped around the station and thus around a bunch of elongate articles located at the station.

Preferably the locating means comprise means for drawing strip material from a stock of such strip material and for feeding that strip material longitudinally adjacent to and past said station.

In an embodiment of this invention said locating means comprise a pair of rollers which co-operate together when driven to draw strip material from said stock and to feed that strip material adjacent to and past the station, a linear actuator which has a movable actuator component which is connected pivotally to a rack which is associated with the teeth of a pinion wheel which is coupled mechanically with one of the rollers so that said one roller is rotated by rotation of the pinion wheel, the rack being interconnected with a fixed component by an interengaged pin and slot connection the axis of the pin being spaced from the axis of the pivot connection between the rack and the movable actuator component, the arrangement being such that rectilinear movement of the movable actuator component in one sense urges the rack teeth into meshing engagement with the teeth of the pinion wheel, so that the pinion is rotated and the said one roller driven, and rectilinear movement of the movable actuator component in the opposite direction separates the rack teeth from the teeth of the pinion wheel so that the rack is returned without the pinion wheel and the rollers being driven for rotation. There may be a pawl which co-operates with the teeth of the pinion gear wheel in order to allow rotary movement of the gear wheel with rectilinear movement of the movable actuator component in said one sense and to lock the pinion gear wheel against rotary movement in the opposite sense.

The movable means may comprise a free end of a pivoted arm, a longitudinal edge of the arm forming a bight into which a bunch of elongate articles, which are positioned at said station to be tied, projects when a length of strip material has been looped around that bunch by pivotal movement of the arm. The arm may be arcuate. The leading end of that part of the longitudinal edge of the arm that defines the bight may be formed as a cylindrical boss. A bight may be formed at the centre of the free end of the arm, that bight being bridged by a portion of the length of strip material as said one end of that length of strip material is moved along the orbital path around said station by the movable means.

Preferably the apparatus includes cutting means for severing a leading length of strip material from the continuous stock thereof.

Preferably the apparatus also includes means for twisting together automatically the ends of a length of strip material which has been looped around a bunch of elongate articles positioned at said station.

The restraining means may comprise an apertured disc which defines an aperture through which strip material is directed by said feeding means, the restraint being afforded by the periphery of the aperture which is engaged by the strip material as the leading end thereof is moved along the orbital path by said movable means. Preferably the apertured disc is supported for rotary movement about an axis which passes between said aperture and a bight in the periphery of the apertured disc, the bight in the apertured disc being adapted to receive the leading end of a length of strip material which has been looped around a bunch of articles positioned at said station to be tied, and means being provided for rotating said apertured disc about said axis when the two ends of a length of strip material looped around a bunch of elongate articles at said station are engaged respectively in said aperture and said bight in the apertured disc so that the rotating means and the apertured disc together function as said twisting means. Conveniently the arm and the apertured disc are arranged so that the leading end portion of a length of strip material that is received within the bight in the periphery of the apertured disc is that portion of strip material that bridges the bight in the free end of the arm as said one end of the length of strip material is moved along the orbital path around said station by the movable means, the bight in the free end of the arm providing clearance for the periphery of the apertured disc during rotation of the latter about said axis.

The apparatus may include ejector means for ejecting from said station a bunch of elongate articles which have been tied by a loop of strip material which was formed around them and twisted together at its ends. The ejector means may comprise a pivoted finger that is movable about its pivot axis so as to sweep the station. Conveniently the pivoted arm and the pivoted finger together comprise a lever which is mounted pivotally adjacent the station.

The station may comprise a recess in the periphery of a baseplate.

Preferably the apparatus includes control gear for controlling the sequential operation of parts of the apparatus. Such control gear may be adapted to control operation of the feeding means so that strip material is fed across said station before a bunch of elongate articles is positioned at said station to be tied, the arrangement being such that the length of strip material which was fed across the station is deflected by the bunch of elongate articles to be tied as that bunch is positioned at the station and is curved by the interaction of the thrust applied to it by the bunch and the reaction imparted by engagement of the leading end of the strip with said moving means. Part of the control gear may control operation of the linear actuator, said control gear part being adapted to be tripped to initiate movement of the movable actuator component in said one sense by return movement of said movable means to the beginning of said orbital path and to be set for return movement of the movable actuator component by arrival of the movable means at the end of said orbital path. The said control gear part may include an actuator button which is adapted to initiate movement of said movable actuator component in said one sense when depressed and to initiate return movement of said movable actuator component when released, a latch lever and an actuator lever which is adapted to depress the actuator button, the finger being adapted to deflect the actuator lever so that the actuator button is depressed as the movable means reach the end of said orbital path, the latch lever being adapted to latch the actuator lever in the position to which it is deflected by the finger, and the arm being adapted to deflect the latch lever to release the actuator lever, and hence to release the actuator button, upon the return of said movable means to the beginning of said orbital path.

Preferably the apparatus includes actuator means for moving said movable means along said orbital path, said control gear including an actuator plunger which is biassed to an inoperative position and which is displaced from that inoperative position by the placement of a bunch of elongate articles to be tied at the station, the actuator plunger being adapted to initiate operation of the actuator means to move said movable means along the orbital path from the beginning of that path when displaced from its inoperative position. The control gear may include a pivotally mounted control valve for said actuator means and latch means which are adapted to latch said control valve in a position in which it interacts with said actuator plunger to effect operation of said actuator means to urge said movable means towards the end of said orbital path, the actuator means being adapted to effect return movement of the movable means towards the beginning of said orbital path when the control valve is released by operation of the latch means for pivotal movement away from the actuator plunger, the control valve being biassed away from the actuator plunger.

The means for rotating said apertured disc about said axis conveniently comprise a rack which meshes with a gear wheel which is connected to said apertured disc for conjoint rotation with said apertured disc about said axis, part of the rack being adapted to strike said latch means to operate said latch means to release the control valve during movement of the rack to rotate said apertured disc about said axis and twist the ends of the length of the strip material together. The cutting means may be operated to cut a length of strip material from the stock thereof after a length of strip material sufficient to be engaged by said movable means has been fed past the station and before the ends of the length of strip material are twisted together.

The various components of the preferred form of apparatus in accordance with this invention are operable pneumatically and the apparatus also includes a pneumatic control circuit for controlling the sequential operation of those components.

One embodiment of apparatus according to this invention will be described now by way of example with reference to the accompanying drawings, of which:

Figure 1:
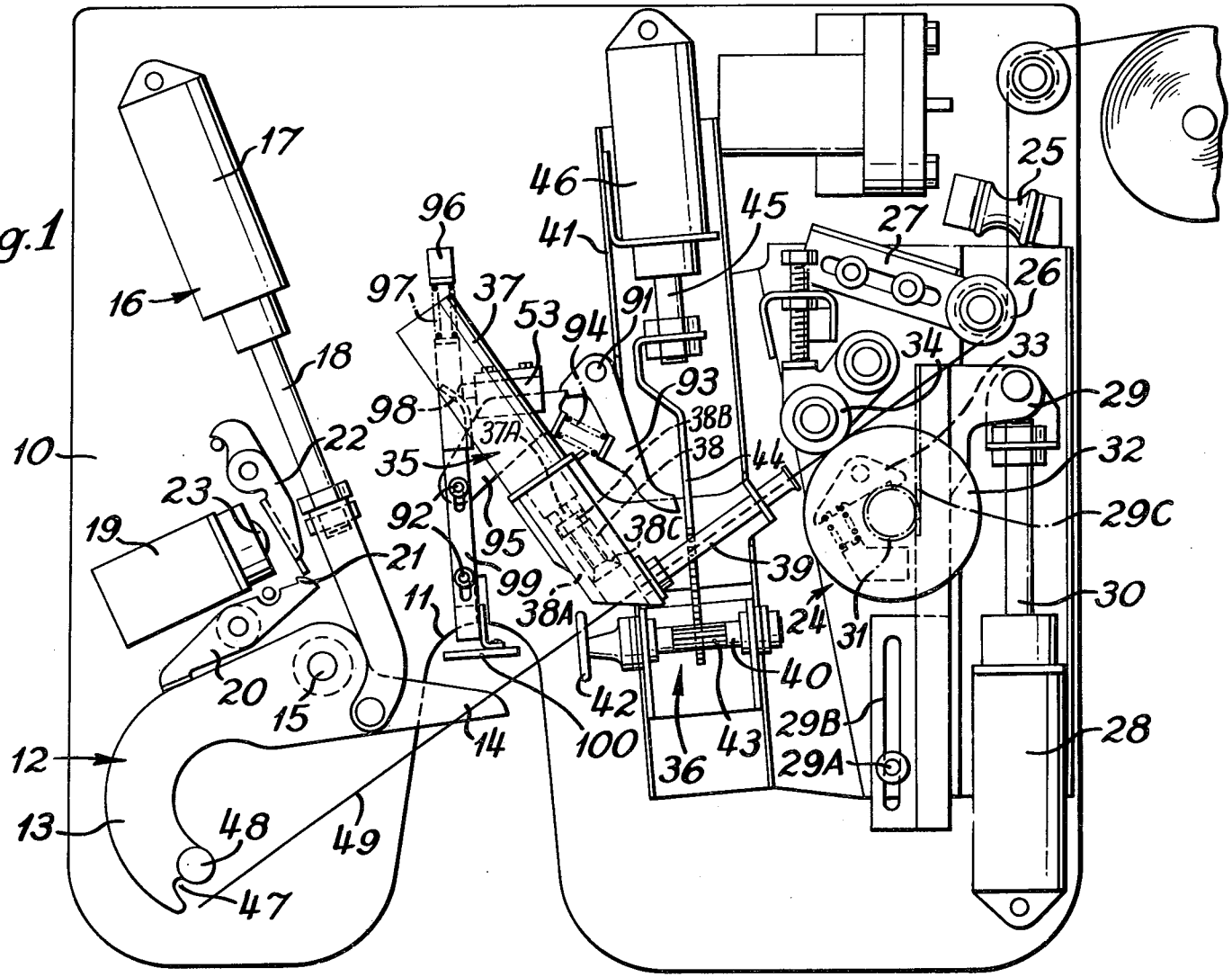
FIG. 1 is a plan view of automatic apparatus for tying bunches of water cress.
Figure 4:
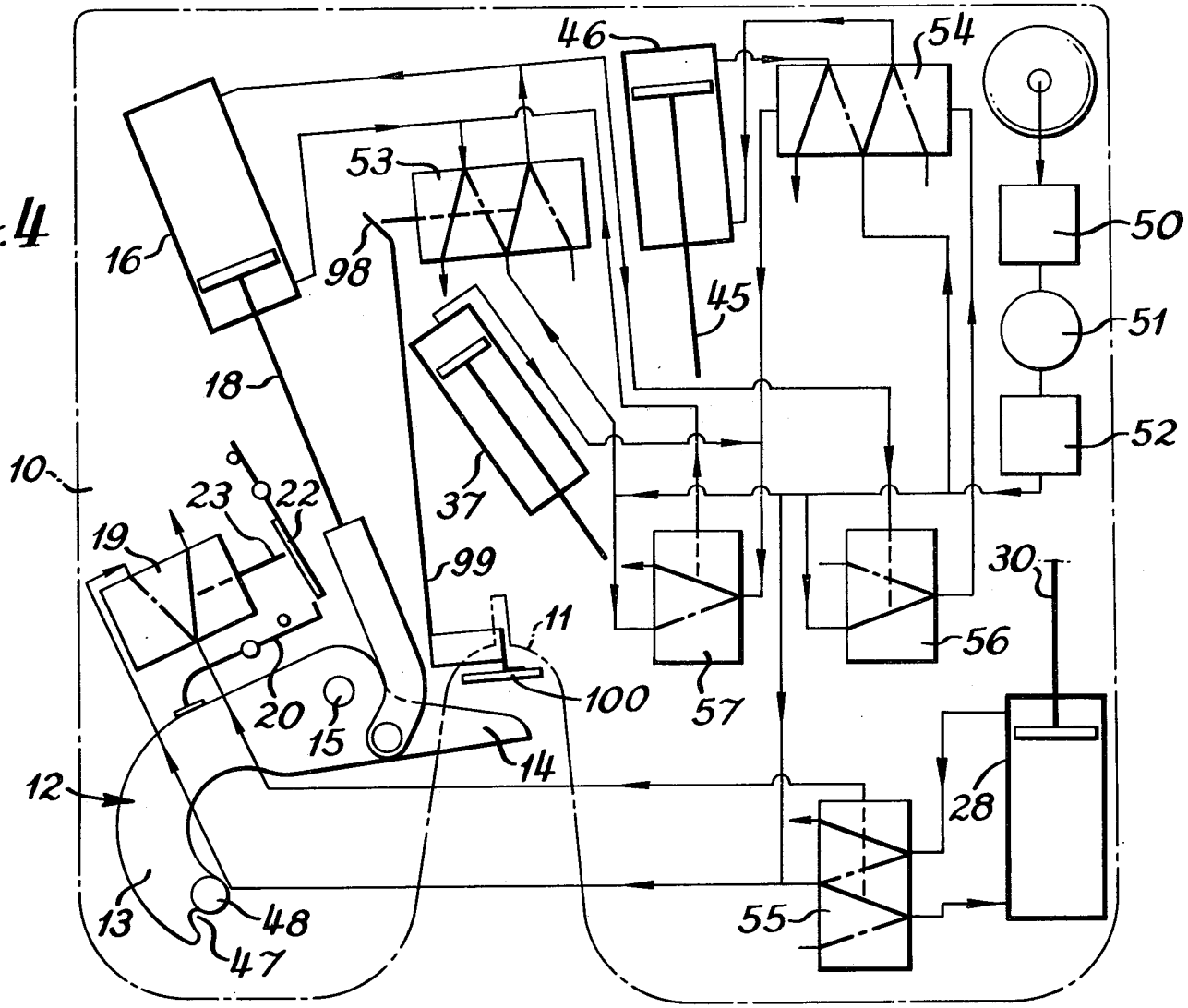
FIG. 4 is a diagram showing the various components of the apparatus of FIG. 1 in the position they adopt when the apparatus is inoperative.
Figure 7:
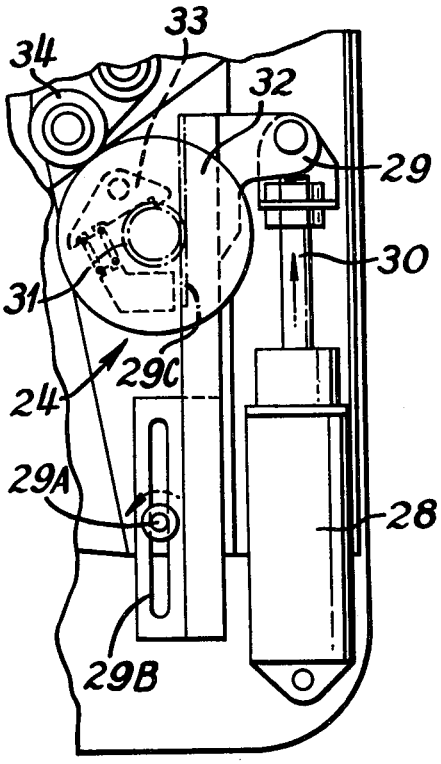
Figure 8:
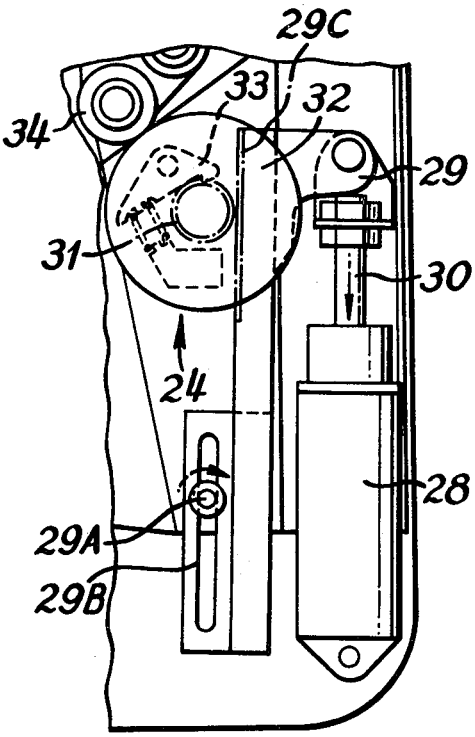
Figure 9:
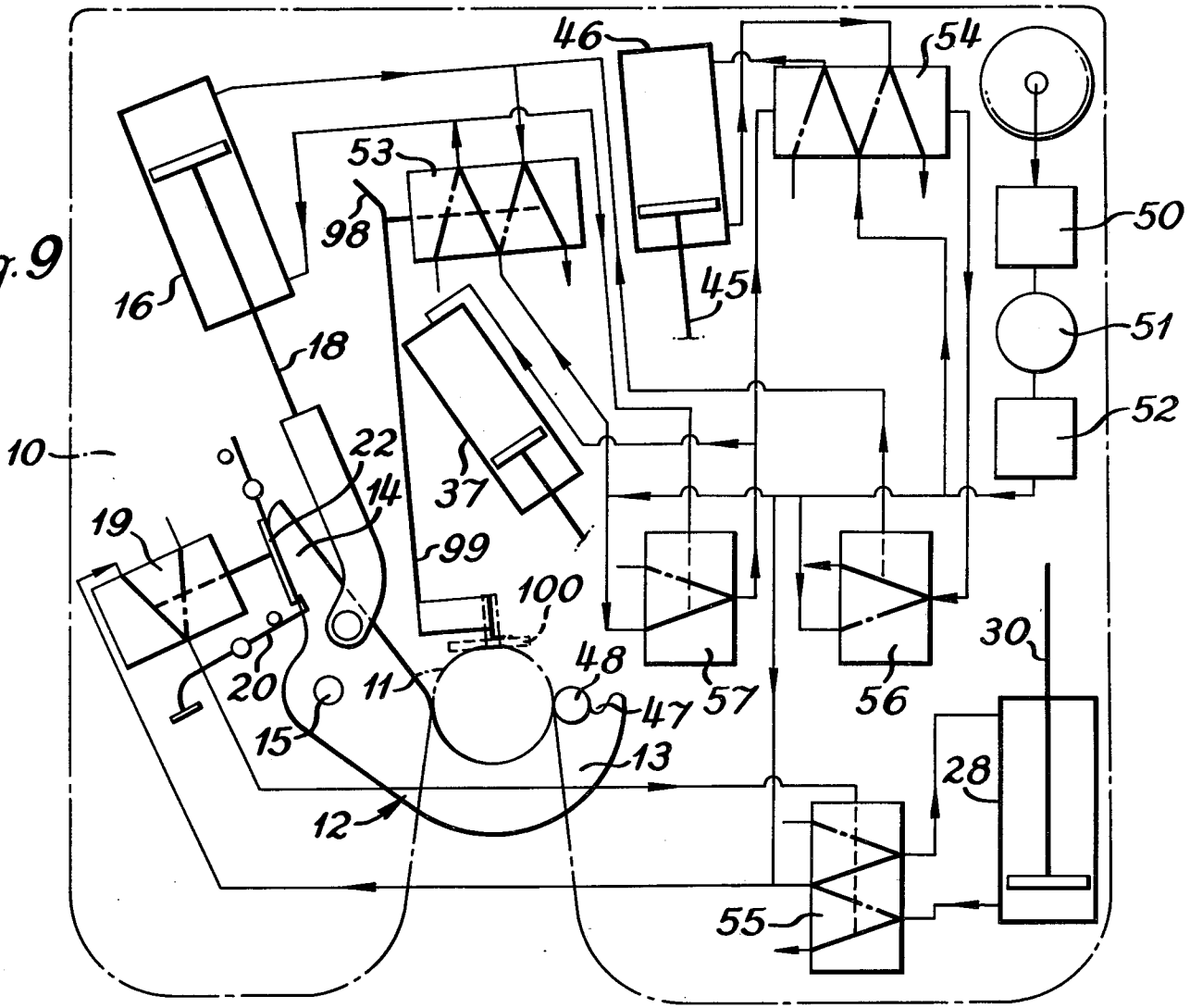

FIG. 7 is a fragment of FIG. 1 showing the condition of other components of the apparatus at an intermediate stage in the operation of the apparatus and FIG. 8 is a similar view showing the same components at a later stage in the operation of the device; and FIG. 9 is a diagram similar to FIG. 4 showing the various components of the apparatus of FIG. 1 in the condition they adopt at an intermediate stage in the operation of the apparatus.

FIG. 1 shows that the components of the apparatus are mounted on a baseplate 10. One of the edges of the baseplate 10 is recessed at 11. The recess 11 has an arcuate inner end wall and outwardly convergent side walls and its length, as measured between the arcuate inner end and its mouth, conveniently is approximately three times its mean width.

Figure 2:
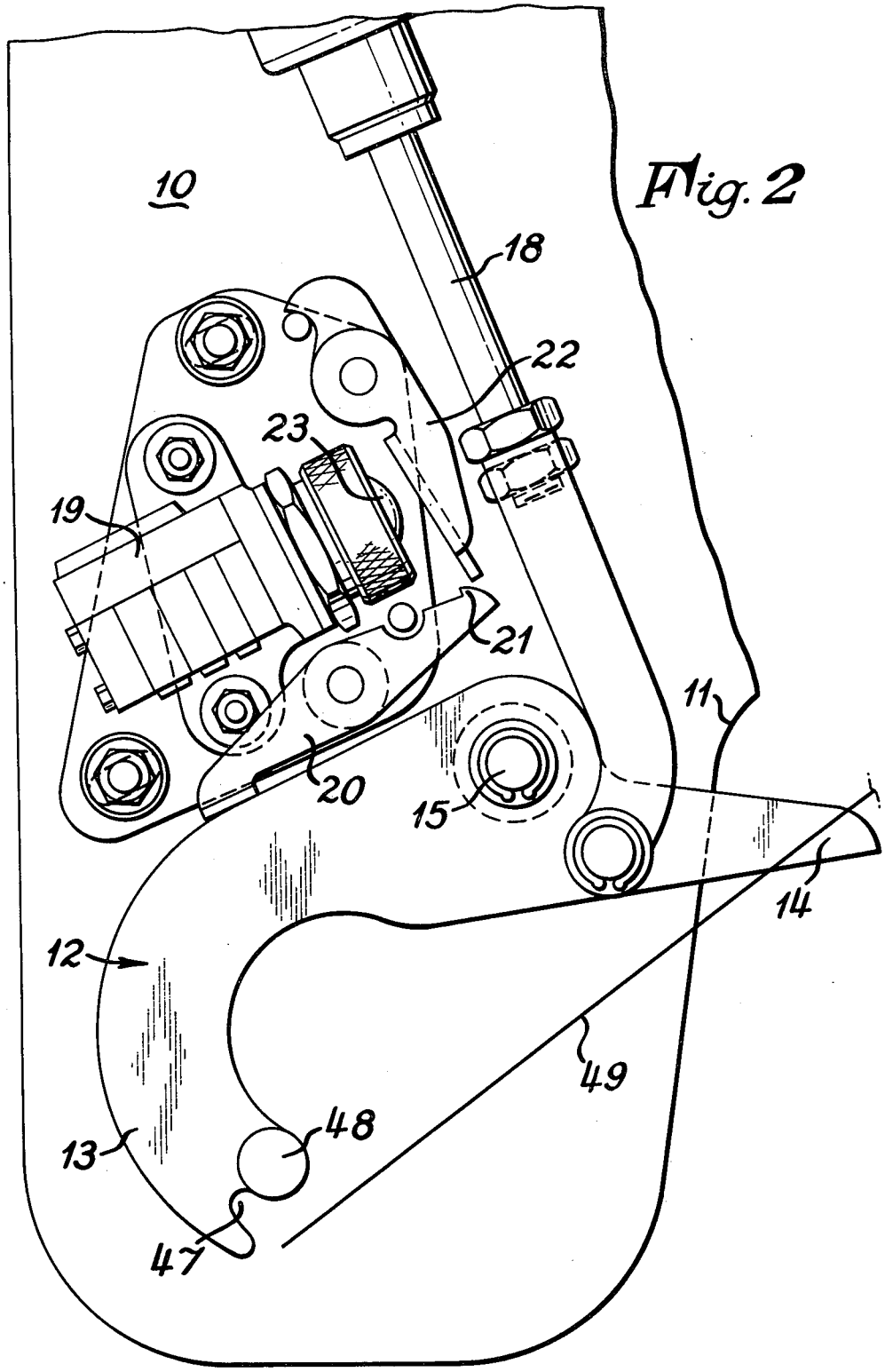
FIG. 2 is a fragment of FIG. 1 drawn to a larger scale and in more detail than FIG. 1.
Figure 3:
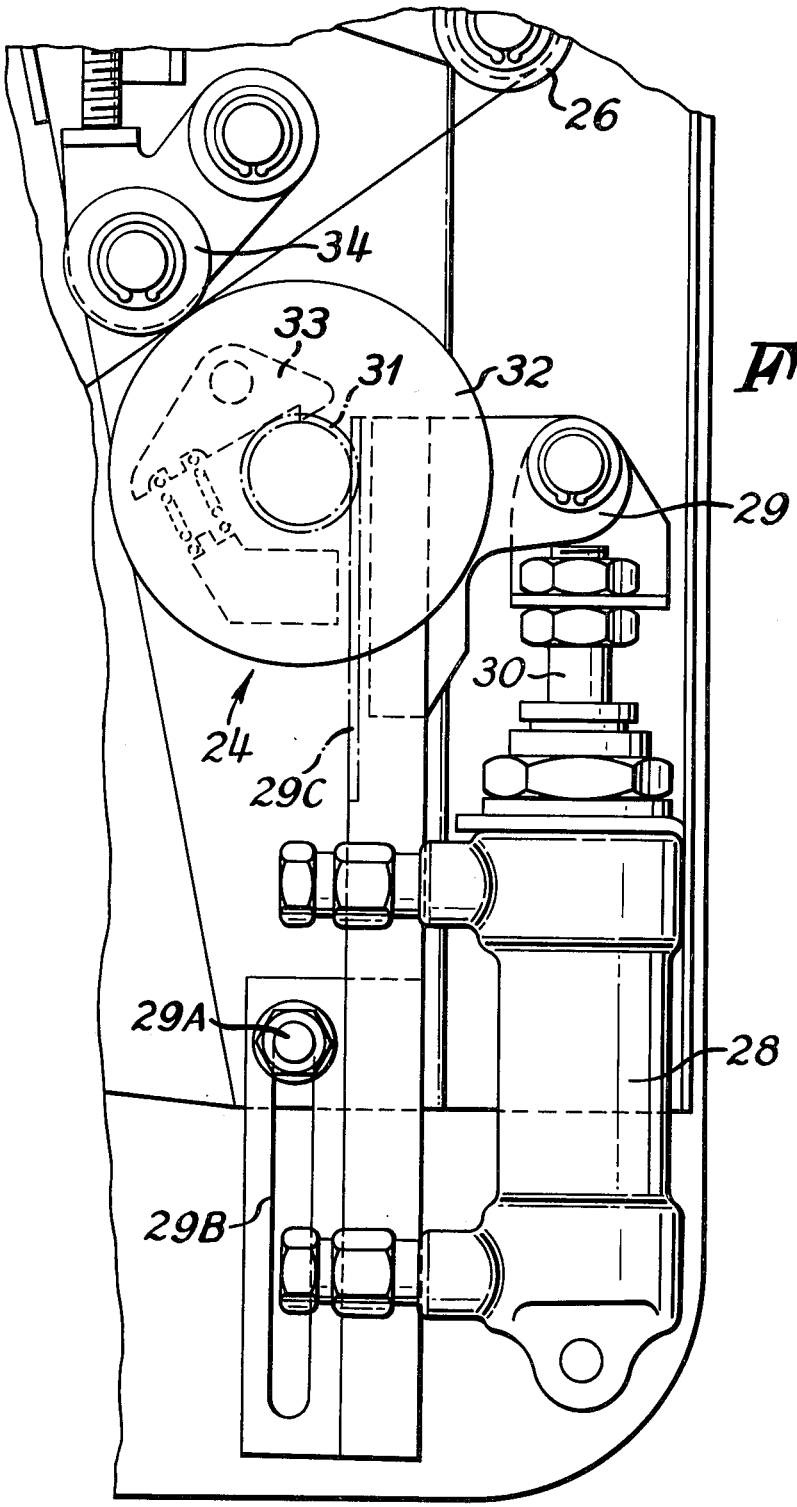
FIG. 3 is another fragment of FIG. 1 drawn to the same scale as FIG. 2.

A lever 12 is pivoted to the baseplate 10. The lever 12 has two arms 13 and 14 of unequal length and different shape which extend in opposite directions from the pivot mounting 15. The longer arm 13 is arcuate and the shorter arm 14, which extends from the pivot mounting 15 in the manner of a finger, has a straight edge on that side of the lever 12 which defines the concave edge of the arcuate arm 13. A double-acting pneumatic jack 16 has its cylinder body 17 mounted pivotally on the baseplate 10 and the free end of its ramrod pinned to the finger-like arm 14 between the tip thereof and the pivot mounting 15. The stroke of the ramrod 18 is such that the lever 12 is pivotable to and fro about the pivot mounting 15 through an angular displacement of the order of 100° – 120°. The pivot mounting 15 is located adjacent the recess 11 so that, when the lever 12 is at one end of its angular travel, the finger-like arm 14 extends partway across the recess 11 (as shown in FIGS. 1, 2 and 4), and, when the lever 12 is at the other end of its angular travel (as shown in FIGS. 5 & 9), the arcuate arm 13 extends right across the recess 11 so that the concave edge thereof co-operates with the arcuate inner edge of the recess 11 to enclose a circular space within which a bunch of water cress to be bound is stationed during use of the apparatus.

The lever 12 is operatively associated with a pneumatic logic valve 19 which is fixed to baseplate 10. When the lever 12 is at said one end of its angular travel, its convex edge engages one end of a spring-loaded latch lever 20 and holds that latch lever 20 against its spring loading so that a detent 21, which is formed at the other end of the latch lever 20, is held spaced and disengaged from the adjacent end of a spring-loaded actuator lever 22. Thus the actuator lever 22 is held against a stop by its spring loading and is spaced from an operating plunger 23 of the logic valve 19 which thereby is free to adopt the state that is determined by its internal bias. Arcuate movement of the lever 12 brings the finger-like arm 14 into contact with the actuator lever 22, then deflects the actuator lever 22 against its spring loading into contact with the operating plunger 23 and finally acts through the actuator lever 22 to deflect the operating plunger 23 against the internal bias of the logic valve 19 so that the state of the logic 19 is changed. The logic valve 19 is held in the new state by the latching interaction of the detent 21 and the adjacent end of the actuator lever 22 as shown in FIG. 5 until the lever 12 is returned to said one end of its arcuate displacement when the logic valve 19 reassumes the original state.

Figure 5:
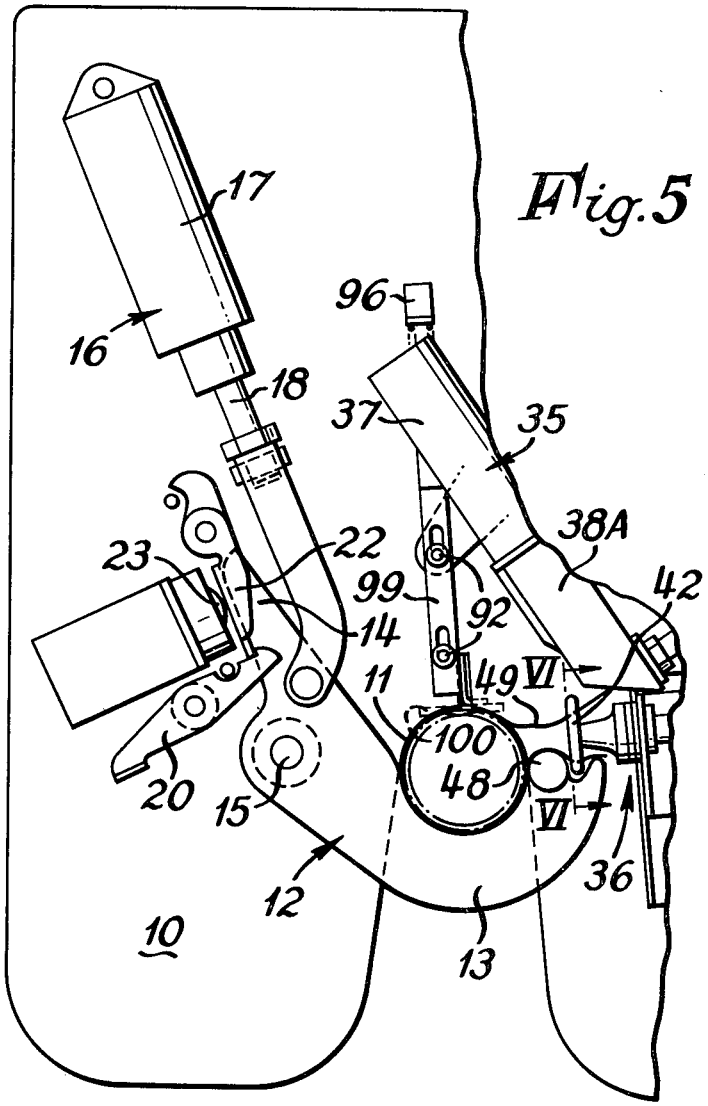
FIG. 5 is a fragment of FIG. 1 showing the condition of some components of the apparatus at an intermediate stage in the operation of the apparatus.

A powered feed roller arrangement, generally indicated at 24 is provided for drawing a continuous length of wire-reinforced paper or plastics binding tape from a stock reel thereof over a guide roll 25, which is supported for rotation about an axis which extends parallel to the baseplate 10 and which is fixed relative thereto, and over adjustably-mounted guide roll 26 which is supported on an adjustable mounting 27 for rotation about an axis which is normal to the baseplate 10, and for feeding such tape along a linear path which extends across that space at the inner end of the recess 11 which is encircled by the arcuate arm 13 and the inner end wall of the recess 11 when the lever 12 is at the said other end of its arcuate travel as shown in FIGS. 5 and 9.

The feed roller arrangement 24 comprises a double-acting pneumatic jack 28 and a rack member 29 which is pinned to the free end of the ramrod 30 of the jack 28, the cylinder body of the jack 28 being fixed to the baseplate 10 and the pin being engaged within an oversize hole in the free end of the ramrod 30. A stud 29A is fixed to the baseplate 10 and projects through a slot 29B in the rack member 29. The slot 29B extends parallel to the line of rack teeth 29C of the rack member 29. The rack teeth 29C co-operate with a pinion wheel 31 which is formed integrally with the shaft of a main drive roller 32 and which has ratchet teeth which co-operate with a spring-loaded pawl 33. The arrangement is such that the drive roller 32 is driven for rotation to feed the continuous length of binding tape towards the recess 11 by movement of the ramrod 30 in one sense to extend the jack 28, as shown in FIG. 7, the rack teeth 29C of the rack member 29 meshing with the pinion wheel 31 and the pawl 33 riding over the ratchet teeth of the pinion wheel 31. During return movement of the ramrod 30 in the opposite sense as shown in FIG. 8, the drive roller 32 is held stationary by engagement of the pawl 33 with the ratchet teeth of the pinion wheel, the pivot mounting of the rack member 29 at the end of the ramrod 30 allowing the rack teeth 29C to slide over the associated teeth of the pinion wheel 31. The main drive roller 32 co-operates with an opposed idler roller 34 to feed the binding tape towards the recess 11, the idler roller 34 being mounted adjustably upon the baseplate 10.

FIG. 1 shows that a cutting device, generally indicated at 35, and a twisting device, generally indicated at 36, are mounted on the baseplate 10 in series between the feed roller arrangement 24 and the recess 11.

The cutting device 35 comprises a double-acting pneumatic jack 37, which is fixed to the baseplate 10 and which is spring loaded into its retracted condition, and a blade plunger 38 which is carried by the ramrod 37A of the jack 37 for rectilinear sliding movement to and fro within the bore of a tubular blade housing 38A. The blade plunger 38 comprises an annular cylindrical body which is screwed coaxially onto the end of the ramrod 37A and which is fixed in position upon the ramrod 37A by a locknut 38B. The cutting edge of the blade plunger 38 is annular and is formed at the end of the linear 38 that is remote from the ramrod 37A at the junction of the outer cylindrical surface of the plunger 38A and an annular surface 38C which tapers radially inwardly from that annular cutting edge towards the locknut 38B. A tubular guide housing 39 guides binding tape en route to the twisting device 36 from the feed roller arrangement 24 and is connected to the blade housing 38A adjacent to the end of the blade housing 38A remote from the jack 37, there being a slot in the wall of the blade housing 38A at the end of the tubular guide housing 39 so that binding tape fed through the tubular guide housing 39 towards the twisting device 36 is passed through the slot and across the interior of the blade housing 38A.

Figure 6:
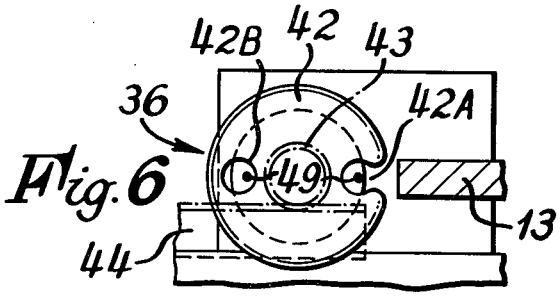
FIG. 6 is a fragmentary section on the line VI — VI of FIG. 5.

The twisting device 36 comprises a spindle 40 which is journaled in the limbs of a channel-section support member 41 which has its base fixed to the baseplate 10. A disc 42 which is carried at one end of the spindle 40 outside the channel-section support member 41, has an arcuate bight 42A (see FIG. 6) formed in its periphery and is apertured also, the centres of the aperture 42B and the bight 42A lying on a common diameter of the disc 42 with the axis of rotation of the spindle 40 passing between them. FIG. 1 shows that a ring of pinion gear teeth 43 is formed at the centre of that part of the spindle 40 which extends between the limbs of the channel section support member 41. A rack 44 is carried by the ramrod 45 of a double-acting pneumatic jack 46 which is mounted upon the base of the channel-section support member 41. The rack 44 comprises a straight portion, which defines the rack teeth at one end and an angled portion which is connected to the other end of the straight portion. The inner limb of the angled portion, which is connected to the straight portion, extends laterally from the straight portion at an angle thereto and the outer limb of the angled portion, which is connected to the ramrod 45, is normal to the straight portion. The rack teeth of the rack 44 are engaged with the gear teeth 43 so that rectilinear movement of the rack 44 with movement of the ramrod 45 rotates the spindle 40 about its axis.

When the ramrod 45 is at one end of its travel, the aperture 42B in the disc 42 is aligned with the linear path through the guide housing 39 for binding tape so that tape fed towards the recess 11 by the feed roller arrangement 34 is guided by passage through the tubular guide housing 39 and is passed through the aperture 42B.

The linear path for binding tape passes over the finger-like arm 14 of the lever 12 when that lever 12 is in the position shown in FIGS. 1, 2 and 4 and is offset from the arcuate arm 13 when the lever 12 is at said one end of its angular travel. The free, or leading, end of the arcuate arm 13 is especially shaped to engage an adjacent portion of a length of binding tape which extends across the recess 11 past the arcuate arm 12 and to push that engaged tape portion before it as the arm 13 is moved by operation of the jack 16 towards the other end of its angular travel which is shown in FIG. 5. The leading end of the arcuate arm 13 defines a bight 47 at its centre, which is bridged by an engaged tape portion during such movement of the arcuate arm 13 from said one end (as shown in FIGS. 1 and 2) to said other end (as shown in FIG. 5) of its angular travel, and a cylindrical boss 48 on the radial inner side of the bight 47.

The orientation of the spindle 40 and the lever 12 are such that, when the lever 12 is at the said other end of its angular travel and the ramrod 45 of the jack 46 is at the said one end of its travel as shown in FIG. 5, so that the aperture in the disc 42 is aligned with the linear path for binding tape, the bight 42A in the periphery of the disc 42 is adjacent to the leading end of the arcuate arm 13 so that a tape portion which bridges the bight 47 in that leading end extends from one side to the other of the disc 42 through the bight 42A and the bight 47 allows the spindle 40 to be rotated so that the two ends of a length of tape which extends through both the aperture 42B and the bight 42A in the disc 42 can be twisted together by rotation of the disc 42 without that disc 42 fouling the adjacent end of the arcuate arm 13.

Referring again to FIG. 1, a plunger 99 is supported upon the baseplate 10 and is guided for rectilinear sliding movement to and fro between two limit positions. The plunger 99 is guided by a spaced pair of pins 92 which each project through a respective one of two slots in the plunger 99, the limit positions being determined by abutment of each pin 92 with a respective end of the respective slot. The plunger 99 projects over the arcuate inner wall of the recess 11 and carries an end plate 100 at one end which is within the respective projected area of the recess 11. A coil spring 97 reacts against an abutment 96, which is fixed to the baseplate 10, and acts upon the other end of the plunger 99 to urge the plunger 99 into the position in which each pin 99 engages a respective end of the respective slot.

A valve support plate 95 is pivoted upon the pin 92 which is further from the end plate 100 and carries a logic valve 53. A sear 93 which is pivoted on a pivot pin 91 which is fixed to the baseplate 10, coacts with a corner of the valve support plate 95, which is remote from the pin 92 upon which that plate 95 is pivoted, in order to lock the plate 95 against pivotal movement about the pivot pin 92. The sear 93 and the valve support plate 95 are held interengaged by a coil spring 94 which acts at one end upon an abutment formed on the valve support plate 95 and at the other end upon an abutment defined on the sear 93 between the detent portion of the sear 93, which receives the said corner of the valve support plate 95, and a curved tail portion of the sear 93 which projects into the path of rectilinear movement of the angled inner limb of the rack 44.

The plunger 99 carries a cam member 98 which cooperates with the actuator button of the logic valve 53 so that the logic valve 53 is set by its internal bias when the cam member 98 is not in contact with its actuator button whereas the actuator button is depressed against the internal bias by the cam member 98 when the valve support plate 95 is locked in position by the sear 93 and the plunger 99 is displaced against the action of the coil spring 97.

When the apparatus is set to receive a bunch of water cress which is to be bound as shown in FIGS. 1 to 4, the jacks 16 and 28 are extended so that the lever 12 is held in the said one condition and so that the length of reinforced tape 49 extends through the tubular guide housing 39, through the slot in the wall of the blade housing 38A, across the interior of the blade housing 38A and through the aperture 42B in the disc 42 and also extends across the finger-like arm 14, the leading end of the tape 49 being adjacent to the leading end of the arcuate arm 13; and the jacks 37 and 46 of the cutting and twisting devices 35 and 36 are retracted.

Referring now to FIG. 4 of the accompanying drawings, a source of compressed air, which is regulated in a conventional manner by a series connected group of devices which comprise a filter 50, a regulator 51 and a lubricator 52, is connected in parallel to the input of the logic valve 53 and to the inputs of each of two other logic valves 54 and 55, which control operation of the jacks 16, 46 and 28 respectively, to the input of each of two pneumatically actuatable pilot valves 56 and 57 as well as to the input of the logic valve 19.

The logic valve 53 normally connects the compressed air supply to the side of the ram piston of the jack 16 which is remote from the ramrod 18 and vents the other side of that ram piston so that the jack 16 is extended. At the same time the logic valve 53 feeds a compressed air signal to the pilot valve 56 so that the output of the pilot valve 56 is connected to its input and a pilot signal is transmitted by the pilot valve 56 to the logic valve 54, that pilot signal setting the logic valve 54 in the condition in which it connects the compressed air supply to the side of the piston of the jack 46 from which the ramrod 45 projects and vents the other side of that piston so that the jack 46 is retracted.

The condition of the logic valve 55 is determined by the condition of the logic valve 19. As is described above, the logic valve 19 is set by its internal bias when the jack 16 is extended, and in this condition the logic valve 55 is in the condition in which the compressed air supply is connected to the side of the ram piston of the jack 28 remote from the ramrod 30, the other side of that piston being vented so that the jack 28 is extended. The jack 37 is normally retracted by its internal spring loading because the cylinder space on the side of its ram piston remote from its ramrod normally is vented through the pilot valve 57 which is de-activated.

A bunch of water cress to be bound is inserted by hand into the recess 11. This action results in the end plate 100 being engaged by the knuckle of the hand by which the operator holds the bunch of water cress and being moved against the action of the coil spring 97. Thus the cam member 98 is moved with the consequent rectilinear movement of the plunger 99 and it co-acts with the actuator button of the logic valve 53 to depress that button and change the state of the logic valve 53. When the logic valve 53 is actuated in this way, the connection of the cylinder spaces on each side of the ram piston of the jack 16 to the source of compressed air and to the vent are reversed as is shown diagrammatically in FIG. 9. Thus the ramrod 18 is retracted and the lever 12 is pivoted about its pivot mounting 15 until the bunch of water cress is encircled by the arcuate arm 13 and the arcuate inner end wall of the recess 11 as shown in FIG. 5. During such angular movement of the arcuate arm 13 its leading end engages the leading end of the length of tape 49 and pushes that leading end of tape along an orbital path around the bunch of water cress so that the length of tape 49, which runs from the leading end thereof back to the aperture 42B in the disc 42 and which was deflected from its linear path by insertion of the bunch water cress into the recess 11, is looped around the bunch of water cress, the periphery of the aperture 42B in the disc 42 restraining the trailing end of that length and ensuring that it does not follow the circular movement of the leading end.

FIG. 9 shows that the change of state of the logic valve 53 and consequent reversal of the connection of the cylinder spaces of the jack 16 to the source of compressed air and to the vent, is accompanied by de-activation of the logic valve 56 and activation of the logic valve 57 which is actuated to connect the compressed air source to the side of the ram piston of the jack 37 remote from the blade 38 so that the blade 38 is advanced to sever the leading length of tape 49 from the continuous length thereof drawn from the stock thereof. The leading length of tape 49 is severed from the continuous length of such tape by the interaction of the blade 38 and the periphery of the slot in the blade housing 38A at the end of tubular guide housing 39. A compressed air signal is also transmitted from the pilot valve 57 as a pilot signal which operates to change the state of the logic valve 54 so that, after the elapse of a time interval sufficient to allow operation of the cutting device 35 to cut the tape 49, completion of the angular travel of the arcuate arm 13 and insertion of the leading end of the tape 49 in the bight 42A in the disc 42, the time interval being the time required for the logic valves 53, 54, 55 and 19 to operate, the connections of the cylinder spaces on each side of the ram piston of the jack 46 to the source of compressed air and to the vent are reversed and the ramrod 45 which carries the rack 44 is advanced so that the spindle 40 and disc 42 are rotated and the ends of the length of tape 49, which is looped around the bunch of water cress, which extend respectively through the aperture 42B and bight 42A in the disc 42 are twisted together and the tie around the water cress is completed. During such advance movement of the rack 44, the sear 93 is deflected from the condition shown in FIG. 1 by engagement of the inner angled portion of the rack 44 with its tail portion so that the valve support plate 95 is released. Thus the logic valve 53 is allowed to reset owing to the loading of its internal bias.

Completion of the angular travel of the lever 12 actuates the logic valve 19 as described previously and as is illustrated diagrammatically in FIG. 9 so that a pilot signal is transmitted to the logic valve 55 to change the state of the logic valve 55 and retract the ramrod of the jack 28. Retraction of the jack 28 and operation of the twisting device 36 conveniently are concurrent.

Now that the logic valve 54 is reset to its normal condition, the jack 16 is extended to the condition that is shown in FIGS. 1 to 4 and the lever 12 is returned to open the recess 11, the bound bunch of water cress being ejected from the recess 11 by the finger portion 14 of the lever 12. Resetting of the logic valve 53 to its normal condition is followed by resetting of the pilot valves 56 and 57 and the logic valve 54 to their normal conditions so that the jacks 37 and 46 of the cutting and twisting devices 35 and 36 are retracted to the conditions shown in FIG. 4.

Ejection of the bound bunch of water cress from the recess 11 allows the plunger 99 to be reset by its coil spring 98 and retraction of the jack 46 of the twisting device 36 allows the sear 93 to re-engage the valve support plate 95 and lock it in position as is shown in FIG. 1.

Finally, when the return angular travel of the lever 12 is completed the latch arrangement which holds the operating plunger 23 of the logic valve 19 depressed is released automatically by the lever 12, as described above, so that the jack 28 is extended to drive the powered feed roller arrangement 24 and advance another length of wire reinforced tape from the stock thereof.

The apparatus is now in condition to bind another bunch of water cress, as shown in FIG. 1.

The apparatus described above with reference to the accompanying drawings is of robust construction and is simple. There is no need to provide means for supporting and guiding the length of strip material that extends between the bight 42A and the aperture 42B of the disc 42, around the bundle to be bound, before the ends of that length of strip material are twisted together. Although the apparatus has been designed particularly for binding bundles of water cress it is suitable for use to bind bundles of similar elongate vegetable matter such as flowers. The various components of the apparatus may be powered by suitable mechanical, electrical or hydraulic means, instead of the pneumatic jacks described, and the control means may be mechanical, electrical or hydraulic instead of the pneumatic control circuit described.

What we claim is:

1. Apparatus for forming a loop of strip material around a bunch of elongate articles which is to be tied so that the ends of a length of strip material so looped can be twisted together to complete a tie around the bunch; the apparatus comprising a. means for locating a length of strip material adjacent a station at which a bunch of elongate articles to be tied is positioned during use of the apparatus, the strip material locating means being adapted to locate such a length of strip material so that it extends laterally with respect to a bunch of elongate articles positioned at said station, said means for locating including means for drawing the length of strip material from a stock of such material and for feeding the length of strip material longitudinally adjacent to and past the station, and guiding means for guiding the length of strip material along a linear path which extends from the point where the strip material exits from the drawing and feeding means adjacent to and past said station;

b. movable means movable to and fro along an orbital path around said station from one rest position and having a part which is adapted to engage part of a length of strip material located adjacent said station by said strip material locating means so as to move one end of that length of strip material around a perimeter of said station, c. means which coact with another part of the length of strip material so as to restrain the other end of the length of strip material from following said one end as said one end is moved around the station by the movable means so that the length of strip material is looped around the station and thus around a bunch of elongate articles located at the station; and d. control gear for controlling sequential operation of parts of the apparatus so that said part of the movable means is located to one side of the linear path when it is at said one rest position and the length of strip material is fed adjacent to and past said station by the feeding means without being deflected from the linear path by said movable means.

2. Apparatus according to claim 1, wherein said strip material locating means comprise a pair of rollers which are adapted to co-operate together when driven to draw strip material from said stock and to feed that strip material adjacent to and past the station, a linear actuator which has a movable actuator component, a toothed rack which is connected pivotally to the movable actuator component, a pinion wheel which has teeth which are associated with the teeth of the rack, the pinion wheel being coupled mechanically with one of the rollers so that said one roller is rotated by rotation of the pinion wheel, a fixed component and interengaged pin and slot connecting means by which the rack and the fixed component are interengaged, the axis of the pin of the interengaged pin and slot connecting means being spaced from the axis of the pivot connection between the rack and the movable actuator component, the arrangement being such that rectilinear movement of the movable actuator component in one sense urges the rack teeth into meshing engagement with the teeth of the pinion wheel, so that the pinion wheel is rotated and the said one roller driven, and so that rectilinear movement of the movable actuator component in the opposite direction separates the rack teeth from the teeth of the pinion wheel so that the rack is returned without the pinion wheel and the rollers being driven for rotation.

3. Apparatus according to claim 2, including a pawl which co-operates with the teeth of the pinion wheel in order to allow rotary movement of the pinion wheel with rectilinear movement of the movable actuator component in said one sense and to lock the pinion wheel against rotary movement in the opposite sense.

4. Apparatus according to claim 2, wherein the control gear is adapted to control operation of the feeding means so that strip material is fed across said station before a bunch of elongate articles is positioned at said station to be tied, and part of the control gear controls operation of the linear actuator, said control gear part being adapted to be tripped to initiate movement of the movable actuator component in said one sense by return movement of said movable means to the beginning of said orbital path and to be set for return movement of the movable actuator component by arrival of the movable means at the end of said orbital path.

5. Apparatus according to claim 4 including ejector means for ejecting from said station a bunch of elongate articles which have been tied by a loop of strip material which was formed around them and twisted together at its ends, said ejector means including a pivoted finger which is movable about its pivot axis to sweep the station, said apparatus comprising a pivoted arm which has a free end and a longitudinal edge, the free end of the arm comprising said movable means and the longitudinal edge forming a bight into which a bunch of elongate articles, which are positioned at said station to be tied, projects when a length of strip material has been looped around that bunch by pivotal movement of the arm, the pivoted arm and the pivoted finger together comprising a lever which is mounted pivotally adjacent the station, wherein said control gear part includes an actuator button which is adapted to initiate movement of said movable actuator component in said one sense when depressed and to initiate return movement of said movable actuator component when released, a latch lever and an actuator lever which is adapted to depress the actuator button, the pivoted finger being adapted to deflect the actuator lever so that the actuator button is depressed as the movable means reach the end of said orbital path, the latch lever being adapted to latch the actuator lever in the position to which it is deflected by the pivoted finger, and the arm being adapted to deflect the latch lever to release the actuator lever, and hence to release the actuator button, upon the return of said movable means to the beginning of said orbital path.

6. Apparatus according to claim 1, comprising a pivoted arm which has a free end and a longitudinal edge, the free end of the arm comprising said movable means and the longitudinal edge forming a bight into which a bunch of elongate articles, which are positioned at said station to be tied, projects when a length of a strip material has been looped around that bunch by pivotal movement of the arm.

7. Apparatus according to claim 6, wherein the arm is arcuate.

8. Apparatus according to claim 6, wherein the leading edge of that part of the longitudinal edge of the arm that defines the bight is formed as a cylindrical boss.

9. Apparatus according to claim 6, wherein a second bight is formed at the centre of the free end of the arm, the second bight being adapted to be bridged by a portion of the length of strip material as said one end of that length of strip material is moved along the orbital path around said station by the movable means.

10. Apparatus according to claim 1, wherein the apparatus includes cutting means for severing a leading length of strip material from the continuous stock thereof.

11. Apparatus according to claim 10, wherein the cutting means comprise a plunger which is slidable rectilinearly within a corresponding bore, the plunger having an annular cutting edge formed by its outer periphery at one end, and an aperture in the cylindrical surface of the bore through which the strip material is fed, the cuttting means being adapted to sever the leading length of strip material from the continuous stock thereof by the interaction of the annular cutting edge of the plunger and the periphery of the aperture.

12. Apparatus according to claim 1, wherein the apparatus also includes means for twisting together automatically the ends of a length of strip material which has been looped around a bunch of elongate articles positioned at said station.

13. Apparatus according to claim 12, including ejector means for ejecting from said station a bunch of elongate articles which have been tied by a loop of strip material which was formed around them and twisted together at its ends.

14. Apparatus according to claim 13, wherein said ejector means comprise a pivoted finger which is movable about it pivot axis so as to sweep the station.

15. Apparatus according to claim 14 comprising a pivoted arm which has a free end and a longitudinal edge, the free end of the arm comprising said movable means and the longitudinal edge forming a bight into which a bunch of elongated articles, which are positioned at said station to be tied, projects when a length of strip material has been looped around that bunch by pivotal movement of the arm, wherein the pivoted arm and the pivoted finger together comprise a lever which is mounted pivotally adjacent the station.

16. Apparatus according to claim 1, wherein the restraining means comprise an apertured disc, there being an aperture which is formed in the apertured disc, the apertured disc being arranged so that the length of strip material directed along said linear path by said feeding means is directed through said aperture, the restraint being afforded by the periphery of the aperture which is engaged by the strip material as the leading end thereof is moved along the orbital path by said movable means.

17. Apparatus according to claim 16, wherein the apertured disc is supported for rotary movement about an axis which passes between said aperture and a bight in the periphery of the apertured disc, the bight in the apertured disc being adapted to receive the leading end of a length of strip material which has been looped around a bunch of articles positioned at said station to be tied, and means being provided for rotating said apertured disc about said axis under the control of the control gear so that, when the two ends of a length of strip material looped around a bunch of elongate articles at said station are engaged respectively in said aperture and said bight in the apertured disc, the ends of the length of strip material are twisted together automatically.

18. Apparatus according to claim 17, wherein a second bight is formed at the centre of the free end of the arm, the second bight being adapted to be bridged by a portion of the length of strip material as said one end of that length of strip material is moved along the orbital path around said station by the movable means, the arm and the apertured disc being arranged so that the leading end portion of the length of strip material that is received within the bight in the periphery of the apertured disc is that portion of strip material that bridges the second bight in the free end of the arm as said one end of the length of strip material is moved along the orbital path around said station by the movable means, the second bight in the free end of the arm being adapted to provide clearance for the periphery of the apertured disc during rotation of the latter about said axis.

19. Apparatus according to claim 1, wherein the station comprises a recess in the periphery of a baseplate.

20. Apparatus according to claim 1, wherein the control gear is adapted to control operation of the feeding means so that strip material is fed across said station before a bunch of elongate articles is positioned at said station to be tied, the arrangement being such that the length of strip material which was fed across the station is deflected by the bunch of elongate articles to be tied as that bunch is positioned at the station and is curved by the interaction of the thrust applied to it by the bunch and the reaction imparted by engagement of said movable means with part of the length of strip material.

21. Apparatus according to claim 20, including actuator means for moving said movable means along said orbital path, said control gear including an actuator plunger which is biassed to an inoperative position and which is displaced from that inoperative position by the placement of a bunch of elongate articles to be tied at the station, the actuator plunger being adapted to initiate operation of the actuator means to move said movable means along the orbital path from the beginning of that path when displaced from its inoperative position.

22. Apparatus according to claim 21, wherein the control gear includes a pivotally mounted control valve for said actuator means and latch means which are adapted to latch said control valve in a position in which it interacts with said actuator plunger to effect operation of said actuator means to urge said movable means towards the end of said orbital path, the actuator means being adapted to effect return movement of the movable means towards the beginning of said orbital path when the control valve is released by operation of the latch means for pivotal movement away from the actuator plunger, the control valve being biassed away from the actuator plunger.

23. Apparatus according to claim 22, wherein the restraining means comprise an apertured disc, there being an aperture which is formed in the apertured disc, the apertured disc being arranged so that the length of strip material directed along said linear path by said feeding means is directed through said aperture, the restraint being afforded by the periphery of the aperture which is engaged by the strip material as the leading end thereof is moved along the orbital path by said movable means, wherein the apertured disc is supported for rotary movement about an axis which passes between said aperture and a bight in the periphery of the disc, the bight in the apertured disc being adapted to receive the leading end of a length of strip material which has been looped around a bunch of articles positioned at said station to be tied, and means being provided for rotating said apertured disc about said axis under the control of the control gear so that, when the two ends of a length of strip material looped around the bunch of elongate articles at said station are engaged respectively in said aperture and said bight in the apertured disc, the ends of the length of strip material are twisted together automatically, and wherein said means for rotating said apertured disc about said axis comprise a rack which meshes with a gear wheel which is connected to said apertured disc for conjoint rotation with said apertured disc about said axis, part of the rack being adapted to strike said latch means to operate said latch means to release the control valve during movement of the rack to rotate said apertured disc about said axis and twist the ends of the length of the strip material together.

24. Apparatus according to claim 20, wherein the apparatus includes cutting means for severing a length of strip material from the continuous stock thereof, the cutting means being operable to cut a length of strip material from the stock thereof after a length of strip material sufficient to be engaged by said movable means has been fed past the station and before the ends of the length of strip material are twisted together.

25. Apparatus for tieing a bunch of elongated articles with a length of strip material, said apparatus including a tieing station at which said articles are positioned when being tied, said apparatus comprising:

a. locating means for locating a length of strip material adjacent said station so that said length extends laterally with respect to a bunch of elongated articles positioned at said station, said lengths having first and second ends, said locating means including forwarding means for forwarding said length from a stock of said material longitudinally adjacent to said station and for forwarding at least one end of said length past said station, and guide means for guiding said length along a linear path, said linear path extending from said forwarding means adjacent and past said station, b. movable means movable along an arcuate path around at least a portion of the perimeter of said station to and from a rest position, said movable means having a part that is adapted to engage a portion of said length located adjacent said station so as to move at least one of said ends of said length around at least a portion of the perimeter of said station, c. means cooperating with said movable means for preventing the other of said ends of said length from following said one of said ends around said portion of the perimeter of said station and for positioning the end portions of said length in adjacent relationship after said one of said ends is moved around said portion of the perimeter of said station, and d. control means for controlling the sequential operation of said apparatus so that said part of the movable means is displaced from said linear path at said rest position so that said length is not deflected by said movable means as said length is forwarded along said linear path.

* * * * *